US007481329B2

(12) United States Patent
Camp, Jr.

(10) Patent No.: US 7,481,329 B2
(45) Date of Patent: Jan. 27, 2009

(54) TRASH RECEPTACLE HAVING A DEPRESSURIZATION APPARATUS

(76) Inventor: William P. Camp, Jr., 455 Lynshire La., Findley, OH (US) 45840

( * ) Notice: Subject to any disclaimer, the term of this patent is extended or adjusted under 35 U.S.C. 154(b) by 185 days.

(21) Appl. No.: 10/447,044

(22) Filed: May 28, 2003

(65) Prior Publication Data

US 2004/0238541 A1 Dec. 2, 2004

(51) Int. Cl.
*B65D 1/40* (2006.01)
*B65D 3/28* (2006.01)
*B65D 25/00* (2006.01)

(52) U.S. Cl. ..... 220/729; 220/720

(58) Field of Classification Search ..... 220/4.26, 220/720–723, 729, 495.04, 495.06, 908, 220/908.1, 908.2, 909, 630, 745; 215/228
See application file for complete search history.

(56) References Cited

U.S. PATENT DOCUMENTS 1,101,286 A * 6/1914 Jones ..... 220/824
2,034,868 A * 3/1936 Henriksen ..... 248/500
2,364,012 A * 11/1944 Walton et al. ..... 229/117.28
2,947,470 A * 8/1960 Hesse et al. ..... 604/134
3,233,951 A * 2/1966 Deal ..... 312/31.2
3,627,171 A 12/1971 Kaplow
3,815,776 A 6/1974 MacMillan
4,127,211 A * 11/1978 Zerbey ..... 220/212
4,351,539 A 9/1982 Rodolakis
4,416,197 A 11/1983 Kehl
4,494,452 A 1/1985 Barzso
4,640,426 A 2/1987 Wasley
4,888,832 A * 12/1989 Cameron ..... 4/321
4,890,760 A 1/1990 Nicoll, Sr. et al.
4,981,233 A * 1/1991 Scheurer ..... 220/212
5,024,653 A * 6/1991 Kohnke ..... 604/35
5,065,891 A 11/1991 Casey
5,125,526 A * 6/1992 Sumanis ..... 220/263
5,143,242 A * 9/1992 Millasich ..... 220/495.02
5,156,290 A 10/1992 Rodrigues
5,163,579 A 11/1992 Jones
5,207,339 A * 5/1993 Shyu ..... 215/228
5,242,074 A 9/1993 Conaway et al.
5,265,755 A 11/1993 McArthur, Jr. et al.
5,269,434 A 12/1993 LaBuda
5,316,170 A 5/1994 Brown
5,355,789 A 10/1994 Suzuki et al.
5,375,732 A 12/1994 Bowers et al.
5,388,717 A 2/1995 LeVasseur
5,390,818 A 2/1995 LaBuda
5,407,629 A 4/1995 Schmidt et al.
5,505,039 A 4/1996 Maier
5,628,424 A 5/1997 Gola
5,645,187 A 7/1997 Brown
5,664,703 A * 9/1997 Reifenberger et al. ..... 222/207
5,680,882 A * 10/1997 Dumke ..... 137/614.2
5,690,247 A 11/1997 Boover
D387,530 S 12/1997 Doxey (Continued)

*Primary Examiner*—Anthony D Stashick
*Assistant Examiner*—Harry A Grosso
(74) *Attorney, Agent, or Firm*—Timothy A. Nathan

(57) ABSTRACT

A trash receptacle having a trash bag or liner attached thereto. The trash receptacle includes an evacuation device designed to evacuate or depressurize the area between the trash receptacle and the trash bag upon insertion of the trash bag within the receptacle.

15 Claims, 10 Drawing Sheets

U.S. PATENT DOCUMENTS

| | | | | |
|---|---|---|---|---|
| D398,117 | S | 9/1998 | Giba | |
| 5,803,303 | A | 9/1998 | Timm et al. | |
| 6,000,571 | A | 12/1999 | Brooks et al. | |
| 6,095,886 | A * | 8/2000 | Beckman et al. | 446/267 |
| 6,594,876 | B1 * | 7/2003 | Stastny | 29/401.1 |
| 7,273,155 | B1 * | 9/2007 | Gray | 220/495.04 |
| 2003/0136279 | A1 * | 7/2003 | Tarlow | 100/90 |

* cited by examiner

TRASH RECEPTACLE HAVING A DEPRESSURIZATION APPARATUS

BACKGROUND OF THE INVENTION

1. Field

The present invention generally relates to receptacles used to hold various items which utilize an inner protective liner. More specifically, the present invention relates to trash receptacles having a trash bag fitted therein and a mechanism adapted to evacuate air from the area between the bag and receptacle.

2. Background

Receptacles are well known in the art and are used to hold and store a variety of items. One such receptacle common in the art is a trash receptacle. In household applications, it has been found desirable to fit a trash bag within the receptacle to facilitate easy removal and disposal of the contents accumulated therein while also preventing leakage within the trash receptacle. Once filled, removal of the trash bag is often resisted by a vacuum created between the bag and the trash receptacle. As one attempts to remove the trash bag, this vacuum impedes removal of the trash bag.

To overcome this problem several references have suggested a variety of solutions. U.S. Pat. No. 5,388,717 to LeVasseur suggests incorporating openings in the lower portion of the trash receptacle to break the seal thus allow the trash bag to be easily removed rather than become suctioned to the container. Although this design may operate effectively for its intended purpose, it does so by compromising the integrity of the trash receptacle. In the event that the trash bag is perforated, trash or debris may leak from the can. In addition, bugs and external contaminates may freely enter the receptacle through the hole.

Other references suggest devices which both break the seal between the trash bag and the receptacle while also deflecting fluid away from the openings formed in the receptacle. For instance, U.S. Pat. No. 5,265,755 to McArthur Jr. et al. describes a trash receptacle having a central stalk with a dome shaped roof overhang. In addition to breaking the seal between the trash bag and the receptacle upon removal of the trash bag as in the '717 patent, the dome shaped roof deflects fluid and debris away from the vent holes. Although adequately deflecting fluid, the stalk and domed roof reduces the overall volume of the receptacle. Moreover, the stalk and roof presents a complicated geometry which itself may snag or perforate the liner.

Other references broadly disclose a trash receptacle which vents the inner cavity about the upper periphery of the receptacle such as U.S. Pat. No. 6,000,571 to Brooks et al. and U.S. Pat. No. 5,375,732 to Bowers et al. The '571 patent describes a trash receptacle with dual side walls which define an air passage therebetween. The base of the inner wall has apertures which are in communication with the air passage permitting air trapped within the receptacle to escape. The device suggested in the '732 patent has an air conduit extending from the base to the upper periphery of the receptacle. The conduit has a plurality of openings formed along its length. Both of these devices may assist in breaking a vacuum within the receptacle; however, they are difficult to manufacture and reduce the overall volume of the receptacle.

Still other devices have been suggested using one-way valves to allow entry of air into the receptacle upon removal of the trash bag while sealing the receptacle in the event that air is forced in the opposite direction. For instance, U.S. Pat. No. 4,890,760 to Nicoll, Sr. et al. discloses a trash receptacle having a flexible flapper valve which covers air holes in the base of the trash can. Similarly, U.S. Pat. Nos. 5,269,434 and 5,390,818 to LaBuda disclose a trash receptacle having a one-way duckbill valve.

Although the above described devices suggest various solutions to breaking the vacuum of a trash receptacle, none of these devices even recognize the problem associated with inserting the trash bag. When inserting a trash bag, the area between the trash receptacle and trash bag becomes pressurized. Although openings in the trash receptacle may provide some assistance, they do not positively assist in evacuating air trapped between the bag and receptacle. The user would still need to physically force the bag into the receptacle and expel the air trapped within the receptacle which often requires substantial labor and bending over at the waist which may be difficult for older users. As discussed above, openings in the trash receptacle compromise the integrity of the trash receptacle. In the event that the trash bag is perforated, trash or debris may leak from the can. In addition, bugs and external contaminates may freely enter the receptacle through the openings.

SUMMARY OF THE INVENTION

The present invention attempts to overcome the deficiencies present in the prior art.

An object of an embodiment of this invention is to provide a vented receptacle;

Another object of an embodiment of this invention is to prevent leakage and isolate the contents of the receptacle; and Still another object of an embodiment of this invention is to provide a vent which evacuates air from between the liner and the receptacle.

In accordance with one exemplary embodiment constructed in accordance with certain teachings of the present disclosure, an assembly is provided having a receptacle. The receptacle includes a bottom wall and a side wall extending from the bottom wall. Together the bottom wall and the side wall define an inner cavity to receive trash, debris, or other objects. To isolate the objects contained within the receptacle, a liner or trash bag may be inserted into the inner cavity of the trash receptacle.

The assembly further includes an evacuation device such as a bellows attached to the receptacle. The bellows is in fluid communication with the inner cavity to evacuate air therefrom. Preferably, the bellows is disposed below the receptacle with a base to support the bellows and receptacle. The base may be either a separate member or integrally formed with the bellows.

In an alternative embodiment, the trash receptacle includes an indentation terminating at an ear that extends from the bottom wall of the receptacle. A bellows is placed on the ear and extends at least partially within the indentation. The indentation permits access to the bellows by the user.

In another embodiment, an assembly is provided having a receptacle and a separate bellows having a pair of one-way valves. In still yet another embodiment, an assembly is provided having a receptacle and an electronic evacuation device. The electronic evacuation device may be integral to the receptacle or a separate member. As a separate member, the electronic evacuation device is connected to the receptacle via a tube. This invention contemplates that the electronic evacuation device may be either a unidirectional or bidirectional pump.

These together with other objects of the invention, along with the various features of novelty which characterize the invention, are pointed out with particularity in the claims. For a better understanding of the invention, its operating advantages and the specific objects attained by its use, reference should be had to the accompanying drawings and descriptive matter in which there is illustrated preferred embodiments of the invention.

BRIEF DESCRIPTION OF THE DRAWINGS

While the specification concludes with claims which particularly point out and distinctly claim the invention, it is believed that the present invention will be better understood from the following description of embodiments taken in conjunction with the accompanying drawings, in which like reference numerals identify identical elements and wherein:

DESCRIPTION OF EMBODIMENTS

Figure 1:
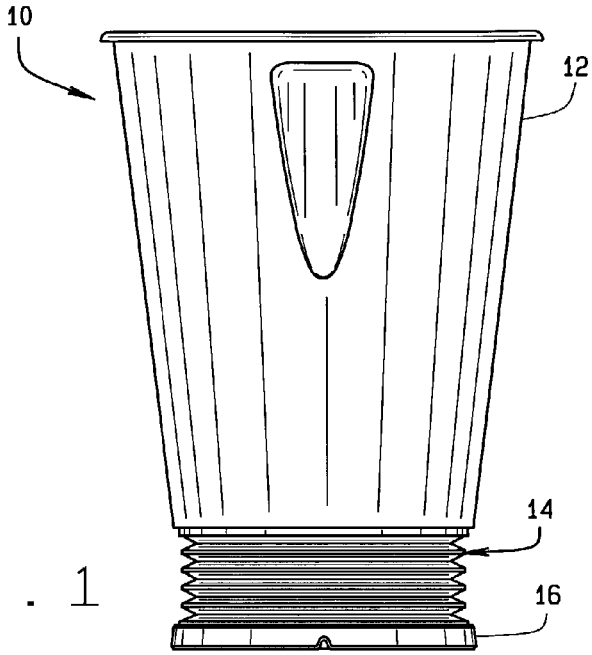
FIG. 1 is a front elevational view of the assembly of the present invention.

As best appreciated with reference to FIG. 1, the present invention provides an assembly 10 having a receptacle 12 wth a trash bag or liner 18 (shown in FIG. 16) inserted therein. The trash liner 18 is sized to be securely fitted to the receptacle 12 to isolate trash or debris contained therein as is well know in the art. The receptacle 12 is coupled to an evacuation device 14 which is supported by a base 16.

Figure 2:
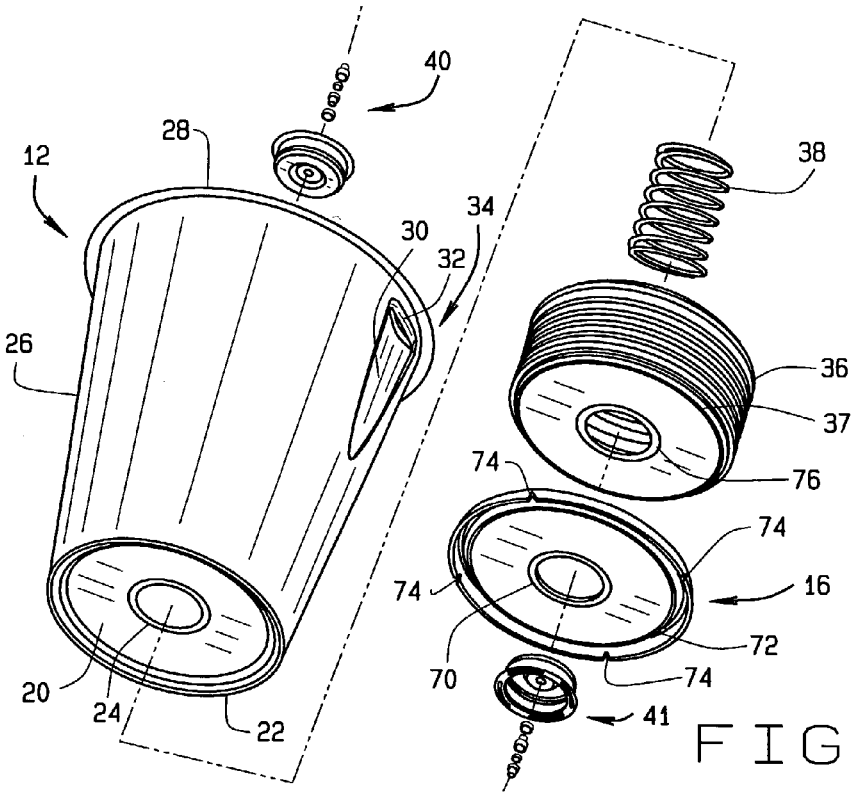
FIG. 2 is an exploded perspective view of the assembly of the present invention.

Turning to FIG. 2, the receptacle 12 has a bottom wall 20 with an undercut 22 about the periphery of the bottom wall 20 and hole 24 extending through the bottom wall 20. The receptacle 12 also includes upstanding side walls 26 which terminate at an upper lip 28 which provides structural rigidity to the receptacle 12 and also serves to retain the trash liner 18 (shown in FIG. 16) as the liner 18 is stretched over the upper lip 28. A pair of scalloped portions 30 are recessed into the side walls 26 and terminate at a ledge 32 thus forming a pair of handles 34 (only one shown).

Figure 3:
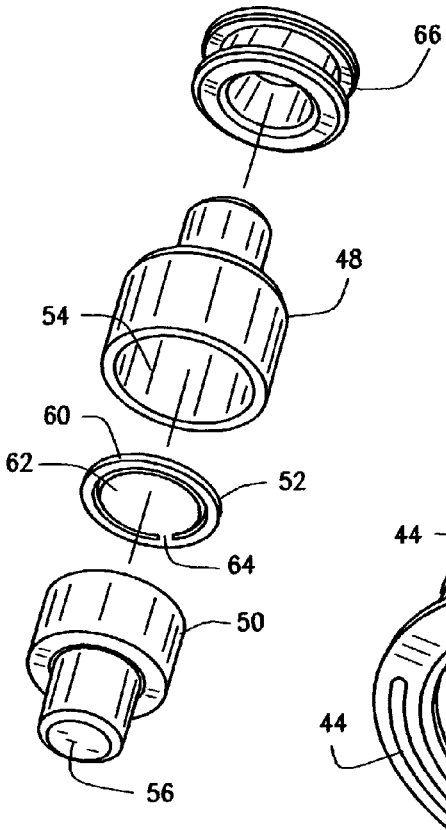
FIG. 3 is a perspective exploded view of a one-way valve.
Figure 4:
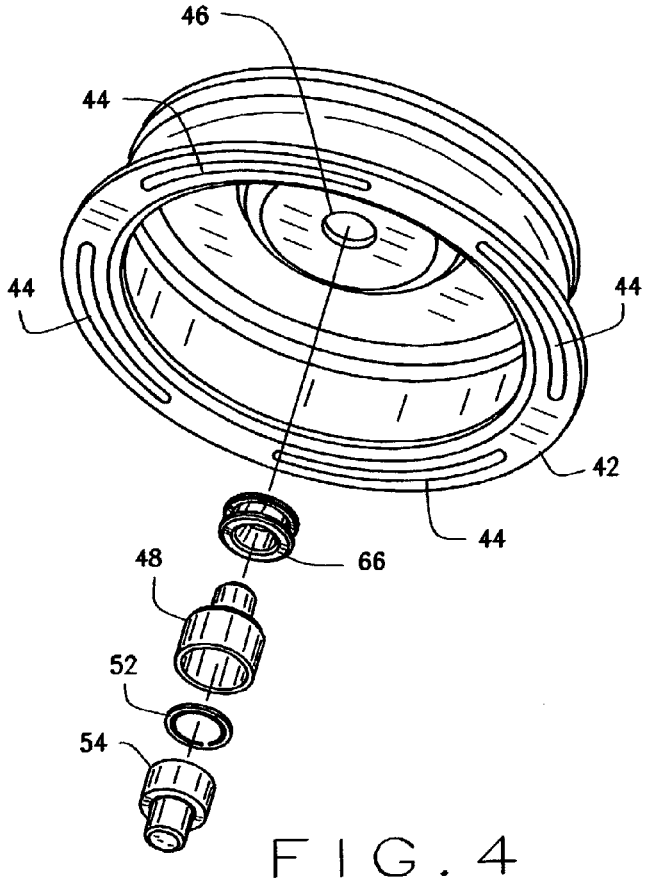
FIG. 4 is a partial exploded perspective view of a valve and associated plug of FIG. 3.
Figure 5:
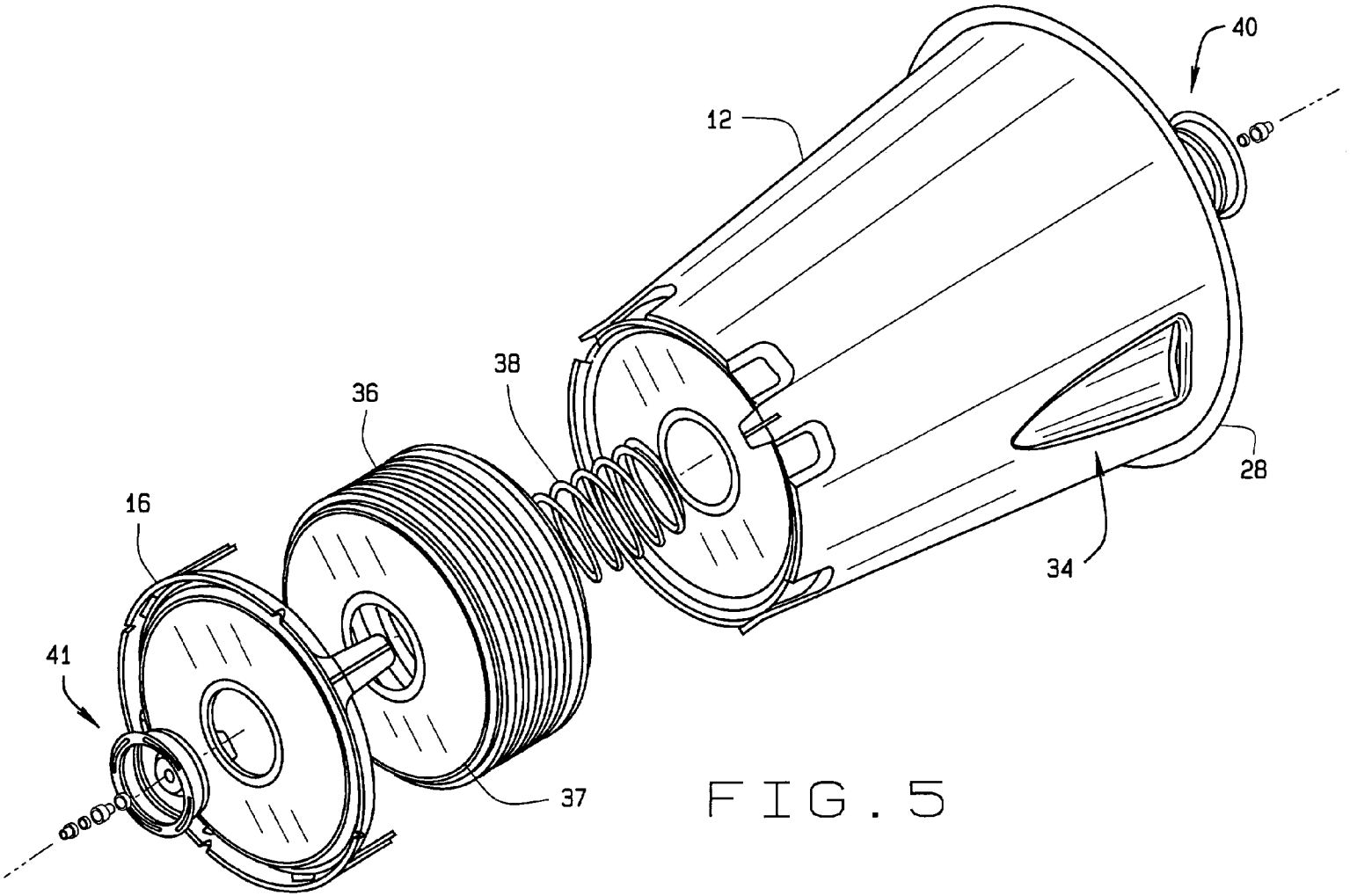
FIG. 5 is an exploded view of an alternative embodiment of the present invention.
Figure 7:
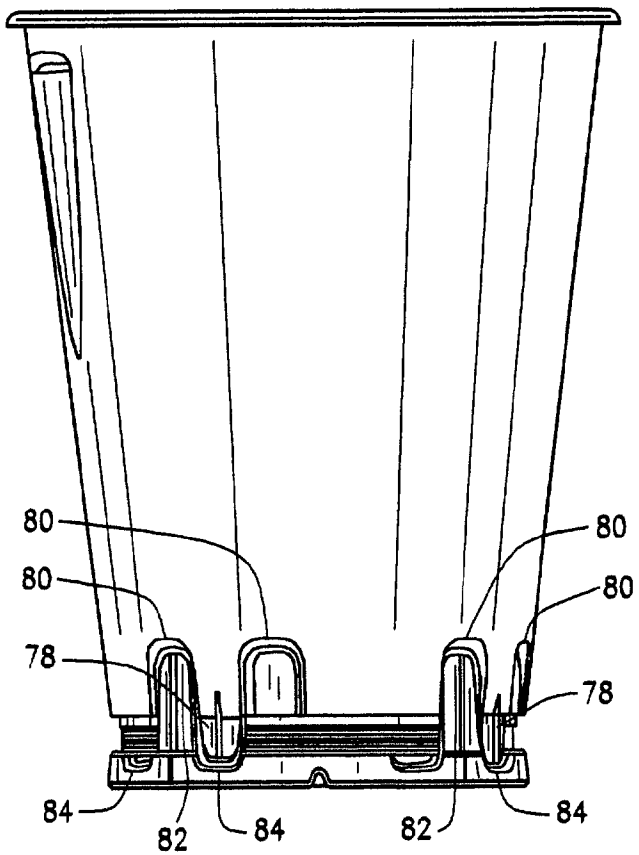
FIG. 7 is a front elevational view of the embodiment of FIG. 5 with a bellows shown in a compressed orientation.
Figure 6:
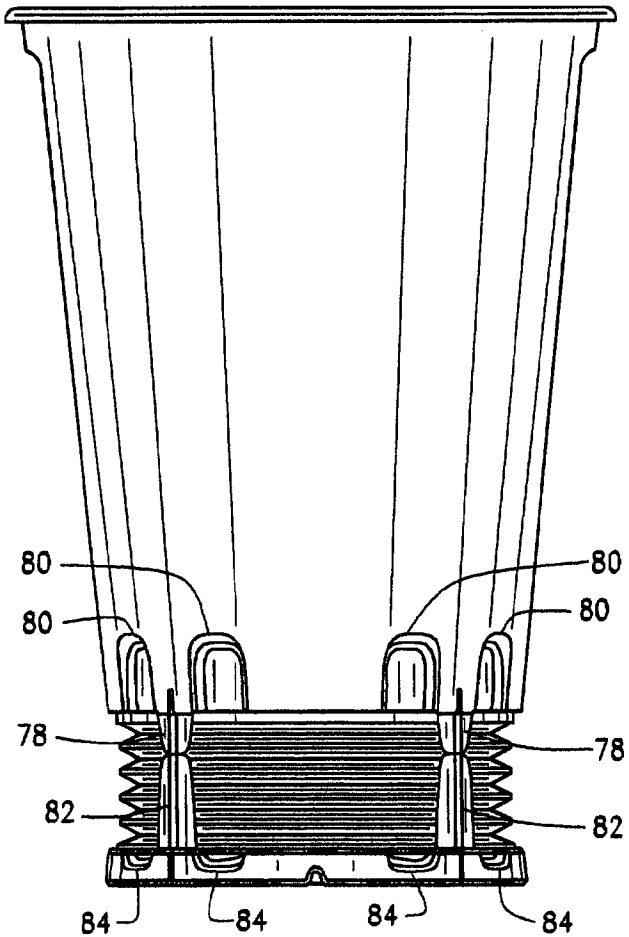
FIG. 6 is a front elevational view of the embodiment of FIG. 5 with a bellows shown in an expanded orientation.
Figure 8:
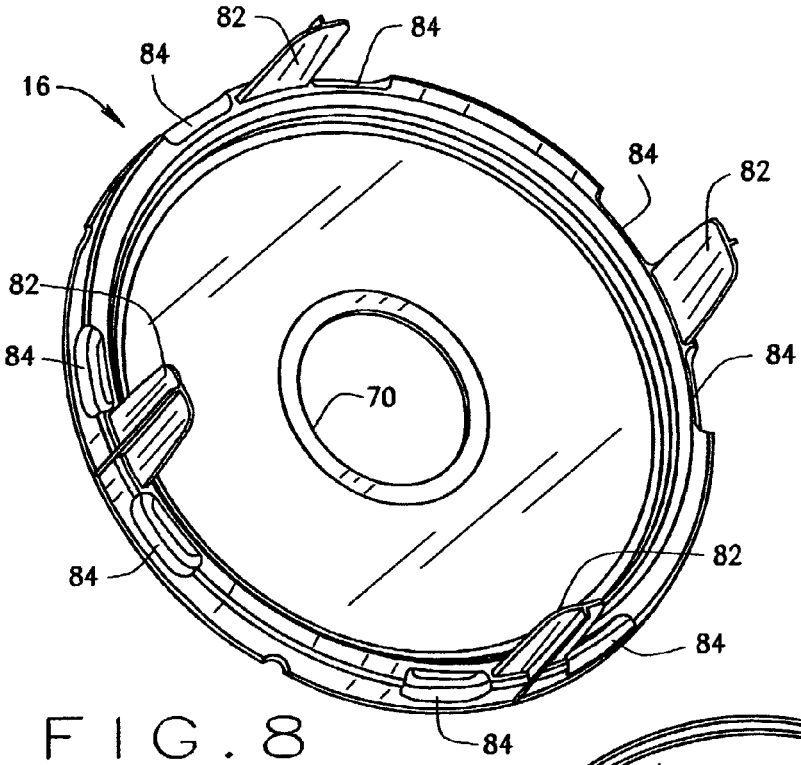
FIG. 8 is a perspective view of the base of the embodiment of FIG. 5.
Figure 9:
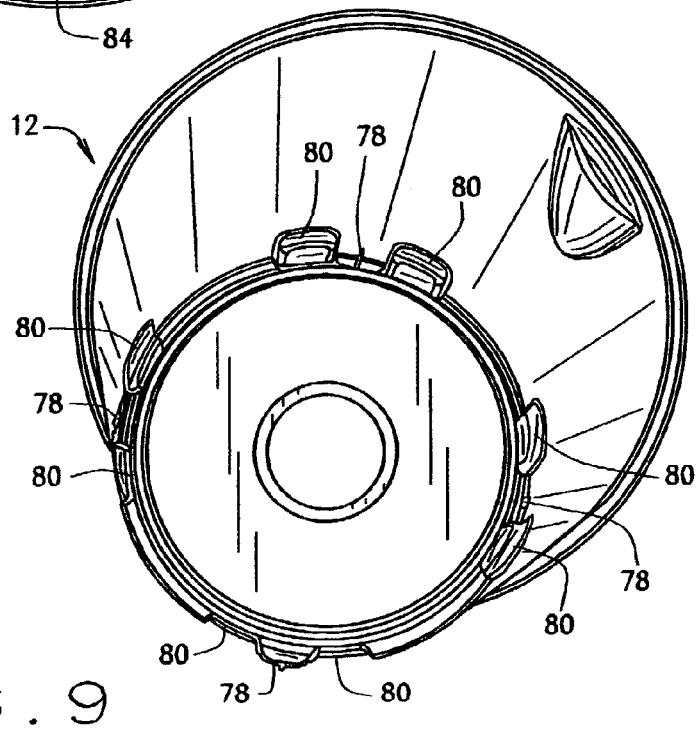
FIG. 9 is a perspective view of the receptacle of the embodiment of FIG. 5.

The evacuation device 14 includes a bellows 36 and a spring 38 disposed within the bellows 36. The bellows 36 has a pair of annular rings 37 and holes 76 (only one shown in FIG. 2). The evacuation device 14 also includes a first valve 40 and a second valve 41. As seen in FIGS. 3 and 4, the assembly 10 has a plug 42 with ribs 44 and a centrally disposed aperture 46. The plug 42 is configured to be fitted into hole 70 and hole 76 to secure the bellows 36 and base 16 together. The ribs 44 are provided to permit airflow and prevent something from easily sealing the evacuation device 14. When in use, the ribs 44 prevent the plug 42 from sealing against the floor. Each valve 40, 41 has a first housing 48 with an internal conduit 54 and second housing 50 with an internal conduit 56, The first housing 48 and second housing 50 are coupled together with a flapper valve 52 contained in an internal cavity 58 formed therebetween. The flapper valve 52 includes an annular ring 60 connected to a membrane 62 by an integral hinge 64. The flapper valve 52 is oriented such that when air is forced into the first housing 48 the integral hinge 64 opens to permit airflow through the valve 40, 41. When air is forced into the second housing 50, the integral hinge 64 closes such that the membrane 62 seals against the internal conduit 54 to prevent airflow through the valve 40, 41. A gasket 66 is fitted about the first housing 48 and inserted into the aperture 46 to provide a hermetic seal between the plug 42 and the valve 40, 41.

The base 16 has a hole 70 with an undercut 72 adapted to securely engage with the one annular ring 37 of bellows 36 while undercut 22 of receptacle 12 sealingly engages with the other annular ring 37 (not shown) of bellows 36. About the periphery of the base 16 is a plurality of channels 74 to permit air to pass out from below the base 16. The bellows has a pair of holes 76 sized to receive and for a substantially hermetic seal with the plug 42. The first valve 40 is oriented to permit airflow out of the receptacle 12 through the hole 24 while resisting airflow into the receptacle through the hole 24. The second valve 41 is oriented to permit airflow out of the bellows 36 and into the external environment. As the bellows 36 is operated, air is removed from the interior of the receptacle 12 and expelled into the environment. When a liner 18 is secured to the receptacle 12, the evacuation device 14 evacuates air captured between the receptacle 12 and the liner 18 to permit the liner 18 to conform to the interior of the receptacle 12.

An alternative embodiment of the present invention is shown in FIGS. 5-9, the assembly 10 includes a support structure to provide additional structural integrity to the assembly 10 including a plurality of tabs 78, 82 and recesses 80, 84. The assembly 10 of this embodiment also includes a plurality of tabs 78 and recesses 80 formed on the receptacle 12. In addition, the base 16 includes corresponding tabs 82 and recesses 84. As the receptacle 12 is filled with debris, the tabs 78 on the receptacle 12 abut the tabs 82 on the base 16. This embodiment allows the weight of the receptacle 12 to be directly transmitted to the base 16 and reduce fatigue on the spring 38 which would occur due to the weight of the debris in the receptacle 12. In addition, this embodiment increases the stability of the assembly 10 during operation by the user. To operate the evacuation device 14, the user simply rotates the receptacle 12 relative to base 16. Once the tabs 78 are aligned with recesses 84 and tabs 82 are aligned with recesses 80, the assembly 10 permits the axial freedom of motion to facilitate axially pumping the bellows 36 to evacuate any air trapped between the receptacle 12 and liner 18. Tabs 78, 82 and recesses 80, 84 of this embodiment assist in maintaining alignment between the base 16 and receptacle 12 such that the force exerted upon the receptacle by the user is transmitted axially through the assembly rather than permitting the receptacle 12 to torque relative to the base 16 and become unstable.

Figure 10:
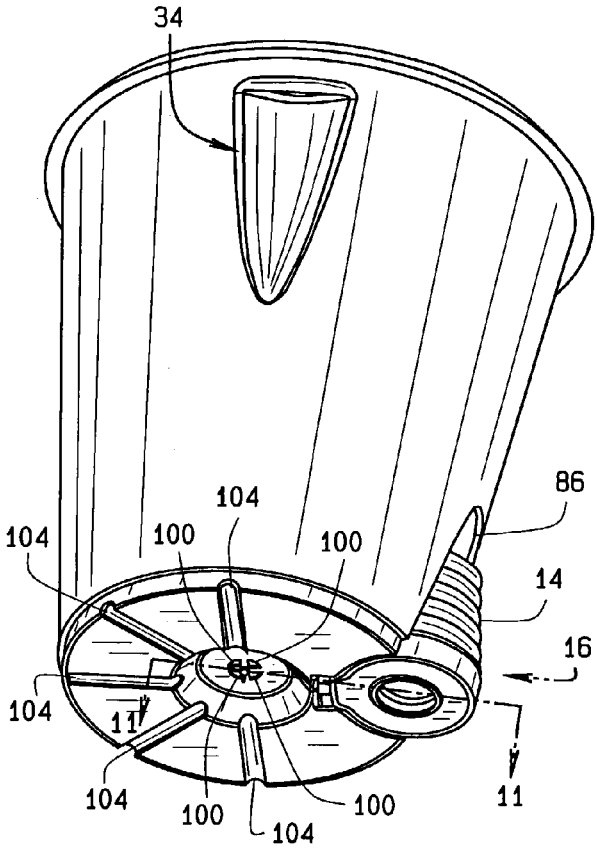
FIG. 10 is a perspective view of a second alternative embodiment of the present invention.
Figure 11:
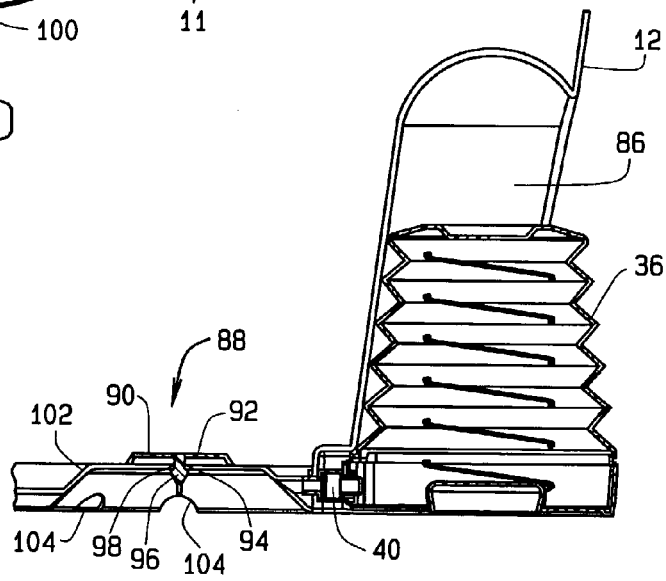
FIG. 11 is a partial cross sectional view of the receptacle of FIG. 10 along line A-A of FIG. 10.

A second alternative embodiment of the present invention is shown in FIG. 10 and FIG. 11. In this embodiment of the invention, the receptacle 12 has a concave region 86 with a base 16 and a bellows 36 fitted at least partially within the concave region 86. The concave portion 86 permits access to the bellows 36 by the user. The valves 40, 41 extend inwardly from the base 16. As best appreciated with reference to FIG. 11, this embodiment also includes a pressurization device 88. The pressurization device 88 includes a one-way valve 90 having a surface 92 and a stem 94 with a hook portion 96. The hook portion 96 is fitted into an opening 98 in the receptacle 12 to secure the one-way valve 90 in place. About the opening 98 is a plurality of air passages 100. The pressurization device 88 operates to release the vacuum created between the liner 18 and the receptacle 12 as the user removes the liner 18 from the receptacle 12.

To prevent fluid or other debris which may escape from the liner 18 to clog the pressurization device 88, the one-way valve 90 is located on a domed portion 102 formed in the receptacle 12. The domed portion 102 operates to direct liquid debris or trash away from the pressurization device 88. To insure that air can freely pass into and out of the receptacle 12, the receptacle 12 has channels 104 formed into the bottom wall 20 of the receptacle 12. The channels 104 extend from the domed portion 102 to the periphery of the bottom wall 20. Although the pressurization device 88 has been discussed with particular reference to the second alternative embodiment, one skilled in the art can best appreciate that this feature may be incorporated into any of the embodiments described herein.

Figure 12:
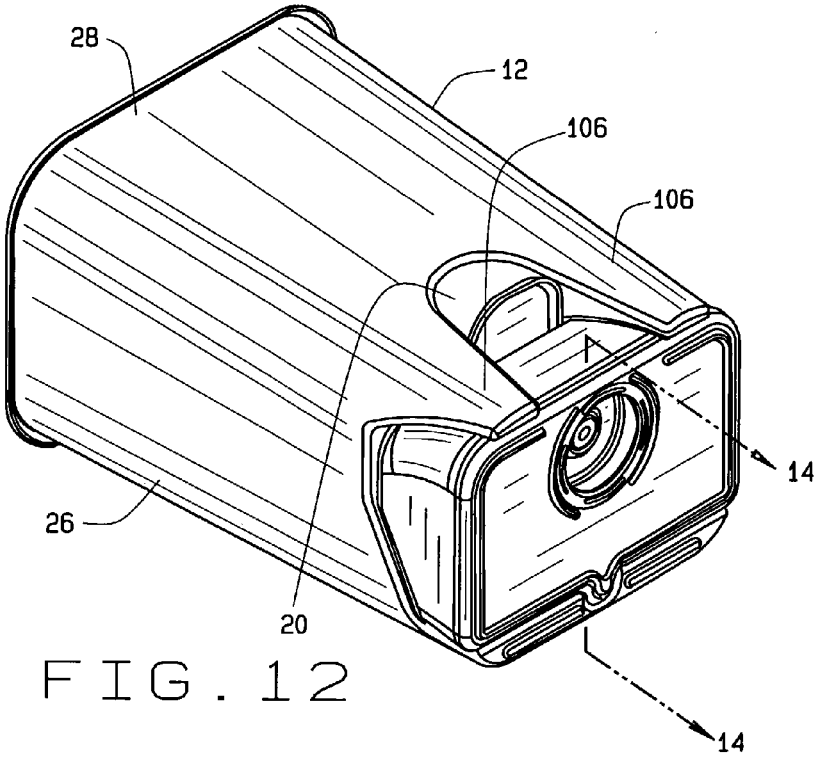
FIG. 12 is a perspective view of a third alternative embodiment of the present invention.
Figure 13:
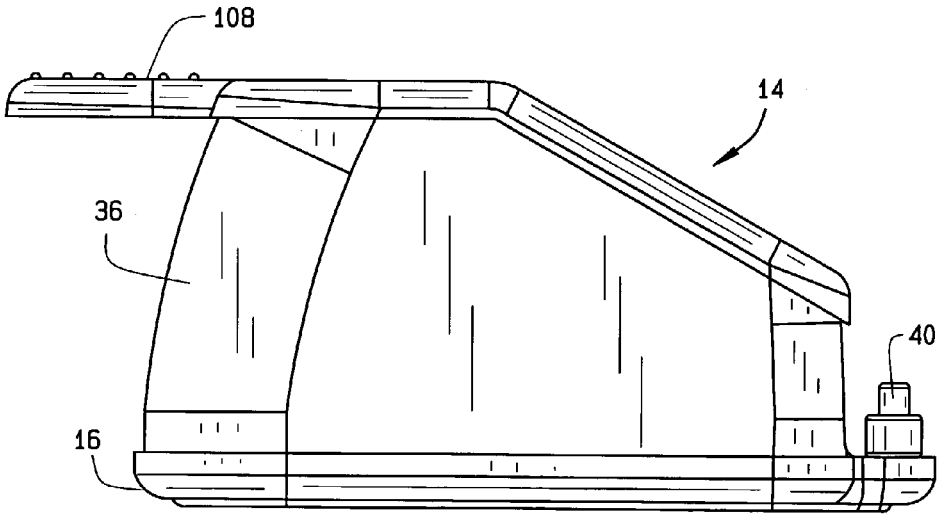
FIG. 13 is a side elevational view of the bellows of the assembly of FIG. 12.
Figure 14:
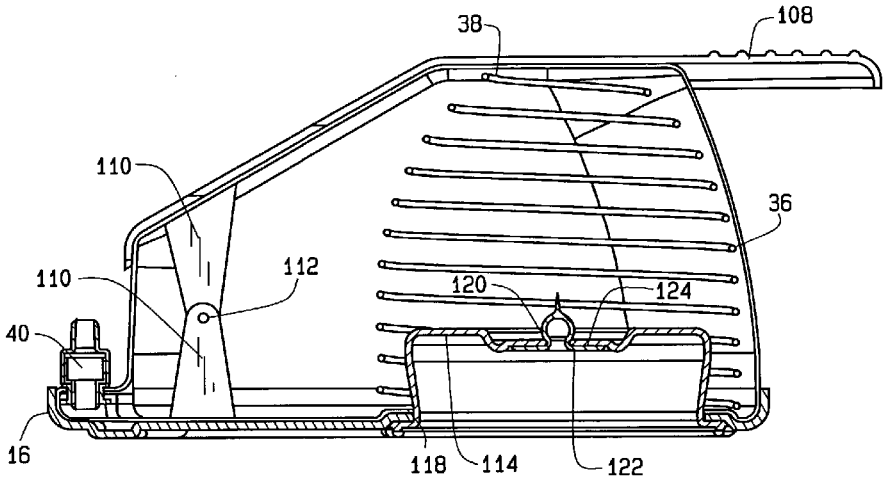
FIG. 14 is a side cross sectional view of the bellows of FIG. 12 along line B-B.

A third alternative embodiment is shown in FIGS. 12-14, this alternative embodiment incorporates the unique features of the present invention into a receptacle 12 having a rectangular cross-section. As in the previous embodiments, the receptacle of this embodiment has a bottom wall 20 and upstanding side walls 26 terminating at an upper lip 28. The side walls 26 have a pair of legs 106 which extend downwardly to provide additional support to the assembly 10. This embodiment also includes a base 16, and an evacuation device 14 having a bellows 36 supported on the base 16. One unique feature of this embodiment is that it includes a pedal 108 to actuate the bellows 36. As is well know in the art, pedal 108 provides mechanical advantage to the user. As seen in FIG. 14, the pedal 108 is pivotably connected to the base 16 via a pair of hinged projections 110 coupled together with a pin 112.

In the third alternative embodiment, the first valve 40 has a similar construction as the previous embodiments; however, the second valve 41 is shown having a different construction than in the previous embodiments. The second valve 41 of this embodiment has a plug 114 fitted into a hole 118 in the base 16. The plug 114 extends into and seals a hole 118 with the bellows 36. The plug 114 includes an aperture 120 into which a one-way valve 122 is fitted. About the aperture 120 is a plurality of passages 124 to permit unidirectional airflow out of the bellows 36.

Figure 15:
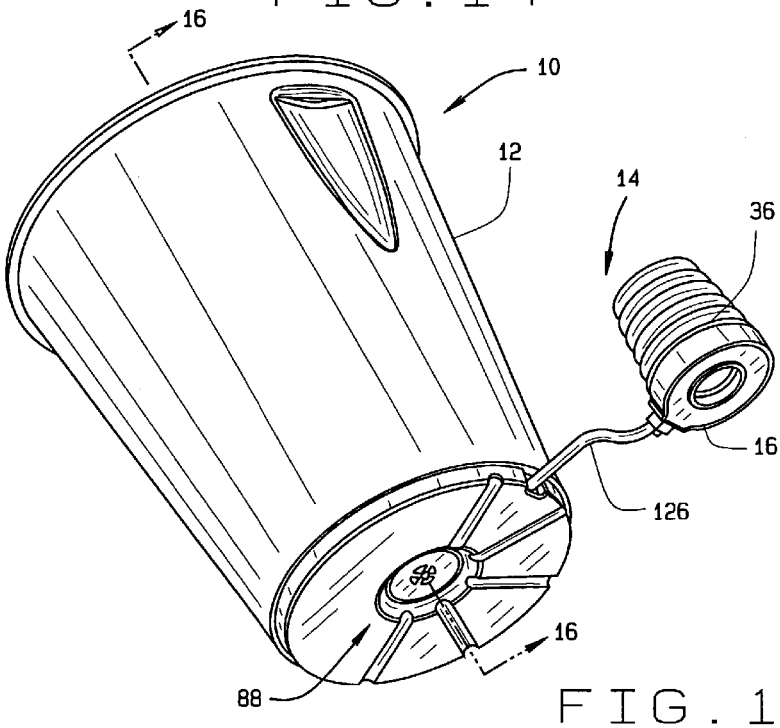
FIG. 15 is a perspective view of a fourth alternative embodiment of the present invention.
Figure 16:
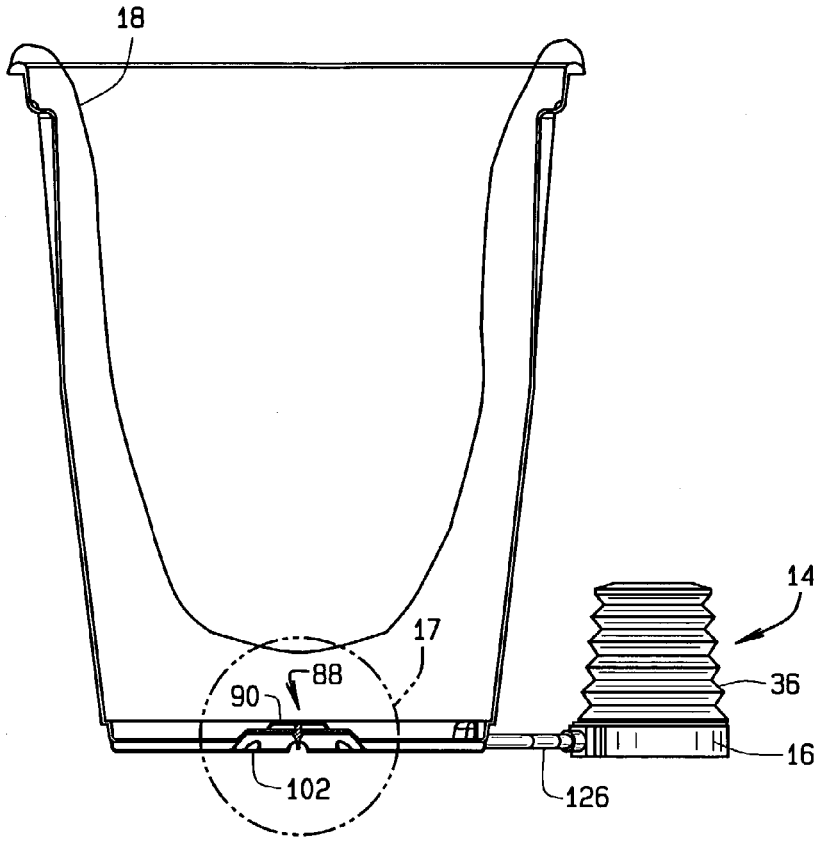
FIG. 16 is a side cross sectional view of the receptacle of FIG. 15 along line C-C.
Figure 17:
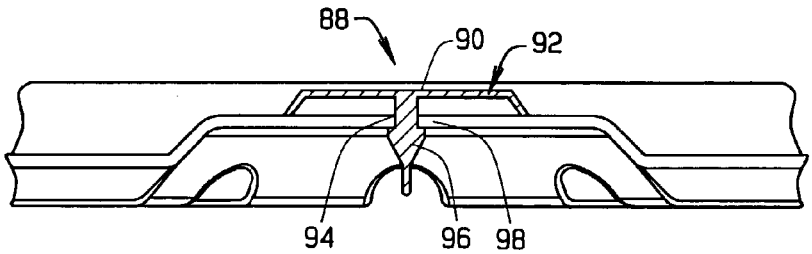
FIG. 17 is a partial side cross-sectional view of the receptacle of FIG. 10.
Figure 18:
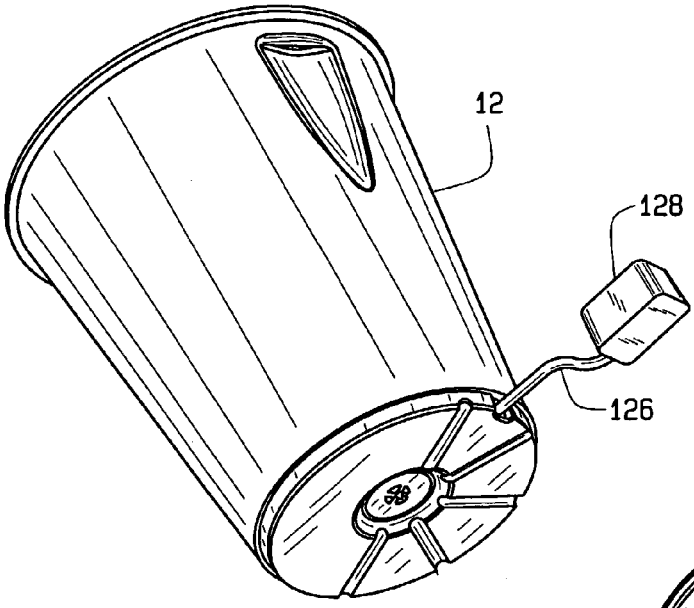
FIG. 18 is a perspective view of a fifth alternative embodiment of the present invention.

A fourth alterative embodiment is shown in FIGS. 15-17. In the fourth alternative embodiment, the evacuation device 14 is a bellows 36 that is spaced from the receptacle 12 and connected via a tube 126 and includes a pressurization device 88 as shown in FIG. 17. FIG. 18 shows a fifth embodiment of the invention wherein the evacuation device 14 is a pump 128 connected via a tube 126. One of ordinary skill in the art can best appreciate that the pump 128 may be unidirectional to draw air out from within the receptacle 12 or may be bidirectional to both draw air out of the receptacle 12 to assist with insertion of the liner 18 and force air into the receptacle 12 to assist in removal of the liner 18 from the receptacle 12. In addition, the pump 128 may be coupled to the receptacle 12 (not shown).

Figure 19:
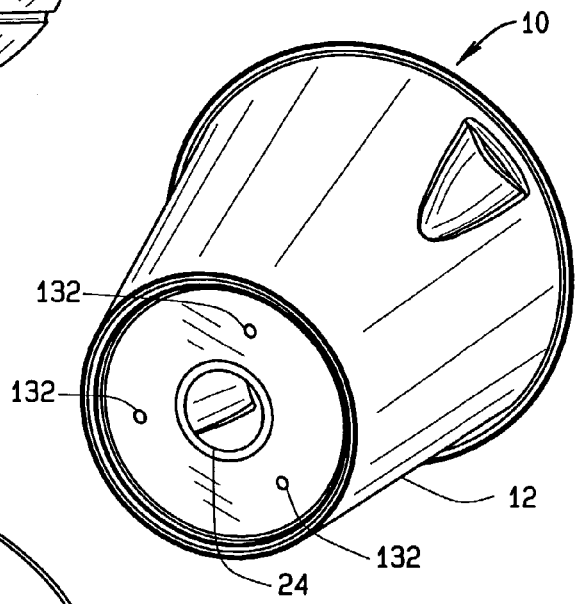
FIG. 19 is a perspective view of a sixth alternative embodiment of the present invention.
Figure 20:
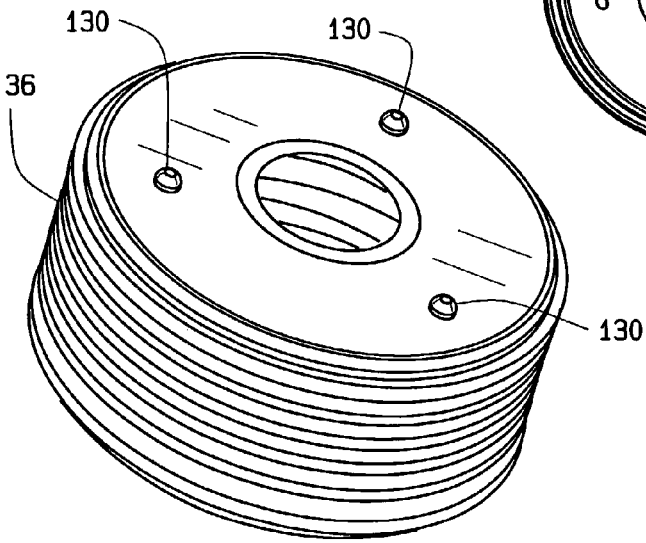
FIG. 20 is a perspective view of the bellows of the sixth alternative embodiment.

As shown in FIGS. 19 and 20, a sixth alternative embodiment has a bellows 36 which engage with integral hooks 130 which engage attachment holes 132 formed in the bottom of the receptacle 12. This embodiment allows for the bellows to be attached to recteptacles 12 which does not have an undercut. This embodiment allows the present invention to be utilized on current receptacles with minimum alteration. Rather than having to modify the receptacle to include an undercut, the user would merely form a hole 24 and a plurality of attachment holes 132 in the receptacle 12.

Although particular embodiments of the present invention have been illustrated and described, modifications may be made without departing from the teachings of the present invention. For instance, the present invention has described the particular configuration of the first valve, the second valve, and the one-way valve. The principle operation of these devices is to permit airflow in one direction and resist airflow in the opposite direction. One of ordinary skill in the art can best appreciate that the there are a variety of devices which can achieve this function such as duck bill valves, one-way flapper valves, pumps and the like. The present invention anticipates the substitution of these various other devices without departing from the teachings of the present invention. Accordingly, the scope of the invention shall be limited only by the following claims.

What is claimed is:

1. An assembly comprising:

a receptacle having a bottom wall and a side wall extending from said bottom wall defining an inner cavity;

a liner adjacent the side walls of the receptacle;

a base for supporting the receptacle; and an evacuation device coupled to the receptacle to evacuate air from between the inner cavity and the liner to expand the liner within the receptacle, wherein said receptacle further comprises a first tab and a first recess, and wherein said base further comprises a second tab and a second recess, whereby said receptacle is supported when said first tab is aligned with said second tab, and whereby longitudinal motion of the receptacle relative to the base is permitted when said first tab is aligned with the second recess to permit insertion of the first tab in the second recess and the second tab is aligned with the first recess to permit insertion of the second tab in the first recess.

2. The assembly as recited in claim 1, wherein said base for supporting said receptacle is formed integrally with said evacuation device.

3. The assembly as recited in claim 1, wherein said evacuation device comprises:

a bellows comprising a flexible membrane having a first opening and a second opening, a spring member disposed within said flexible membrane, a first valve fitted within said first opening and a second valve fitted within said second opening.

4. The assembly as recited in claim 3, wherein first valve and said second valve each comprise:

a male member having a conduit;

a female member configured to interface with said male member to form a substantially air tight seal, said male member and said female member defining an internal cavity; and a one-way valve fitted within said cavity to permit air flow in one direction and resisting air flow in said opposite direction.

5. The assembly as recited in claim 4, wherein said one-way valve is a duckbill valve.

6. The assembly as recited in claim 4, wherein said one-way valve is a flapper valve.

7. An assembly comprising:

a receptacle having a bottom wall and a side wall extending from said bottom wall defining an inner cavity, said side wall terminating at an upper lip, said receptacle including a first tab and a first recess about the bottom wall;

a base for supporting the receptacle having a surface and an annular ring extending therefrom, the annular ring includes a second tab and a second recess, whereby said receptacle is supported when said first tab is aligned with said second tab, and whereby longitudinal motion of the receptacle relative to the base is permitted when said first tab is aligned with the second recess to permit insertion of the first tab in the second recess and the second tab is aligned with the first recess to permit insertion of the second tab in the first recess;

a liner; and a bellows disposed between said receptacle and said base for evacuating air from between the inner cavity and the liner to expand the liner within the receptacle.

8. An assembly comprising:

a receptacle having a bottom wall and a side wall extending from the bottom wall defining an inner cavity;

a liner adjacent the side wall of the receptacle; and a base for supporting the receptacle; and an evacuation device coupled to the receptacle to evacuate air from between the inner cavity and the liner to expand the liner within the receptacle, wherein said evacuation device is proximate the receptacle, wherein said receptacle further comprises a first tab and a first recess, and wherein said base further comprises a second tab and a second recess, whereby said receptacle is supported when said first tab is aligned with said second tab, and whereby longitudinal motion of the receptacle relative to the base is permitted when said first tab is aligned with the second recess to permit insertion of the first tab in the second recess and the second tab is aligned with the first recess to permit insertion of the second tab in the first recess.

9. The assembly as recited in claim 8, wherein said evacuation device includes at least one valve located within the receptacle.

10. The assembly as recited in claim 9, wherein said at least one valve is a first one-way valve and a second one-way valve configured to evacuate air from within the receptacle.

11. The assembly as recited in claim 10, wherein said first valve and said second valve are duckbill valves.

12. The assembly as recited in claims 10, wherein said first valve and said second valve are flapper valves.

13. The assembly as recited in claim 8, wherein said evacuation device is at least partially contiguous with the receptacle.

14. The assembly as recited in claim 8, wherein said evacuation device is between the bottom surface of the receptacle and the base.

15. The assembly as recited in claims 8, wherein said evacuation device is at least partially contiguous with the bottom surface of the receptacle, and wherein said evacuation device is at least partially contiguous with the base.

* * * * *